US009919894B2

(12) United States Patent
Nishida

(10) Patent No.: US 9,919,894 B2
(45) Date of Patent: Mar. 20, 2018

(54) FESTOON DEVICE

(71) Applicants: Fuji Seiko Co., Ltd., Gifu-ken (JP); Fuji Shoji Co., Ltd, Gifu-ken (JP)

(72) Inventor: Kihachiro Nishida, Gifu-ken (JP)

(73) Assignees: Fuji Seiko Co., Ltd. (JP); Fuji Shoji Co., Ltd. (JP)

( * ) Notice: Subject to any disclaimer, the term of this patent is extended or adjusted under 35 U.S.C. 154(b) by 161 days.

(21) Appl. No.: 14/766,792

(22) PCT Filed: Feb. 15, 2013

(86) PCT No.: PCT/JP2013/053723
§ 371 (c)(1),
(2) Date: Aug. 10, 2015

(87) PCT Pub. No.: WO2014/125625
PCT Pub. Date: Aug. 21, 2014

(65) Prior Publication Data
US 2015/0360902 A1 Dec. 17, 2015

(51) Int. Cl.
*B65H 51/20* (2006.01)
*B65H 51/12* (2006.01)

(52) U.S. Cl.
CPC ..... *B65H 51/20* (2013.01); *B65H 51/12* (2013.01); *B65H 2701/36* (2013.01)

(58) Field of Classification Search
CPC ..... B65H 51/20; B65H 51/12; B65H 59/36; B65H 2701/36
See application file for complete search history.

(56) References Cited

U.S. PATENT DOCUMENTS 3,587,992 A * 6/1971 Seibel ..... B21C 47/04 242/598.3
3,643,497 A 2/1972 LeCompte
4,065,044 A * 12/1977 Painter ..... G11B 15/28 226/188
4,186,861 A * 2/1980 Steinhilber ..... B65H 51/20 226/118.2

FOREIGN PATENT DOCUMENTS

CA 2254986 A 5/2000
CN 1222113 A 7/1999
(Continued)

OTHER PUBLICATIONS

Machine translation of JP 2002-68598A, retrieved Mar. 10, 2017.*
(Continued)

*Primary Examiner* — Michael C McCullough
(74) *Attorney, Agent, or Firm* — Tarolli, Sundheim, Covell & Tummino LLP

(57) ABSTRACT

A festoon device includes a frame, which extends vertically, an upper pulley, which is rotationally supported by an upper part of the frame, and a lower pulley, which is rotationally supported by the frame below the upper pulley and is selectively moved up and down. The frame rotationally supports two auxiliary pulleys, which are arranged at a position closer to the frame than the upper pulley and the lower pulley. The festoon device is configured such that a wire is looped about the upper pulley and the lower pulley after being looped about the auxiliary pulleys.

4 Claims, 3 Drawing Sheets

(56) References Cited

FOREIGN PATENT DOCUMENTS

| | | | |
|---|---|---|---|
| CN | 1559789 | A | 1/2005 |
| JP | 55-33786 | U | 8/1978 |
| JP | 2000-512607 | A | 9/2000 |
| JP | 2000512607 | A | 9/2000 |
| JP | 2002068597 | A | 3/2002 |
| JP | 2002068598 | A | 3/2002 |
| JP | 2006-007494 | A | 1/2006 |
| JP | 2009046257 | A | 3/2009 |
| JP | 2012007266 | A | 1/2012 |
| KR | 10-2000-0016774 | A | 3/2000 |
| SU | 172708 | A | 8/1965 |
| WO | 9748548 | A1 | 12/1997 |
| WO | WO 97/48548 | | 12/1997 |

OTHER PUBLICATIONS

International Preliminary Report on Patentability for corresponding PCT/JP2013/053723 dated Aug. 18, 2015 by Yukari Nakamura of the International Bureau of WIPO.
International Search Report for PCT/JP2013/053723, dated Mar. 12, 2013, pp. 1-4.
Office Action for Russian Application No. 2015138707 dated Jan. 16, 2017.
Office Action for Chinese Application No. 201380072662.3 dated Jan. 20, 2017.
Translation of Japanese Office Action for Application No. 2015-500061 dated Oct. 11, 2016.

* cited by examiner

FESTOON DEVICE

RELATED APPLICATIONS

The present invention is a U.S. National Stage under 35 USC 371 patent application, claiming priority to Serial No. PCT/JP2013/053723, filed on 15 Feb. 2013, the entirety of which is incorporated herein by reference.

BACKGROUND OF THE INVENTION

The present invention relates to a festoon device that stores wires and feeds the wires to a bead core shaping device, for example, in a process of manufacturing bead cores used for vehicle tires.

Patent Document 1 discloses a conventional structure of this type of a festoon device, for example. This conventional structure includes a frame, which supports an upper pulley at an upper part of the frame to be rotational about an axis extending in the front-back direction of the frame. A lower part of the frame supports a lower pulley to be rotational about an axis extending in the front-back direction of the frame and selectively moved up and down. The frame rotationally supports two auxiliary pulleys, which are arranged at an upper part and a lower part on a lateral side in the frame width direction of the lower pulley. A wire that is coated with rubber by a die in a preparation process of manufacturing bead cores is looped around the auxiliary pulleys of the festoon device. After that, the wire is looped around the upper and lower pulleys multiple times, and then stored. The wire is fed to a bead core shaping device, which carries out a finishing process of manufacturing bead cores.

When the moving amount of the wire per unit time (hereinafter, simply referred to as a moving amount), which is fed from the festoon device to the bead core shaping device, becomes larger than the moving amount of the wire to be fed from the die to the festoon device, the lower pulley is moved up. In contrast, when the moving amount of the wire fed from the festoon device to the bead core shaping device becomes less than the moving amount of the wire fed from the die to the festoon device, the lower pulley is moved down. This absorbs the difference between the moving amount of the wire fed from the die, which carries out the preparation process, and the moving amount of the wire fed to the bead core shaping device, which carries out the finishing process. Thus, the tension of the wire is maintained at a constant level.

In the conventional festoon device, the frame supports the auxiliary pulleys, which are arranged on the lateral side in the frame width direction of the lower pulley. Thus, the conventional festoon device has a problem of increasing the frame width, thereby increasing the size of the festoon device.

PRIOR ART DOCUMENT

Patent Document

Patent Document 1: Japanese National Phase Laid-Open Publication No. 2000-512607

SUMMARY OF THE INVENTION

Accordingly, it is an objective of the present invention to provide a festoon device capable of reducing the overall size by decreasing the frame width.

To achieve the above objective, a festoon device according to one aspect of the present invention includes a frame, which extends vertically, an upper pulley, which is rotationally supported by an upper part of the frame, and a lower pulley, which is located below the upper pulley and rotationally supported by the frame. The lower pulley is selectively moved up and down. Two auxiliary pulleys are arranged closer to the frame than the upper pulley and the lower pulley and are rotationally supported by the frame. The festoon device is configured such that the wire is looped about the upper pulley and the lower pulley after being looped about the auxiliary pulleys.

Therefore, this festoon device is configured to decrease the size of the festoon device without increasing the frame width.

The aforementioned festoon has an advantage to reduce the overall size of the device.

DETAILED DESCRIPTION OF THE PREFERRED EMBODIMENTS

A festoon device according to one embodiment will now be described with reference to the drawings.

Figure 1:
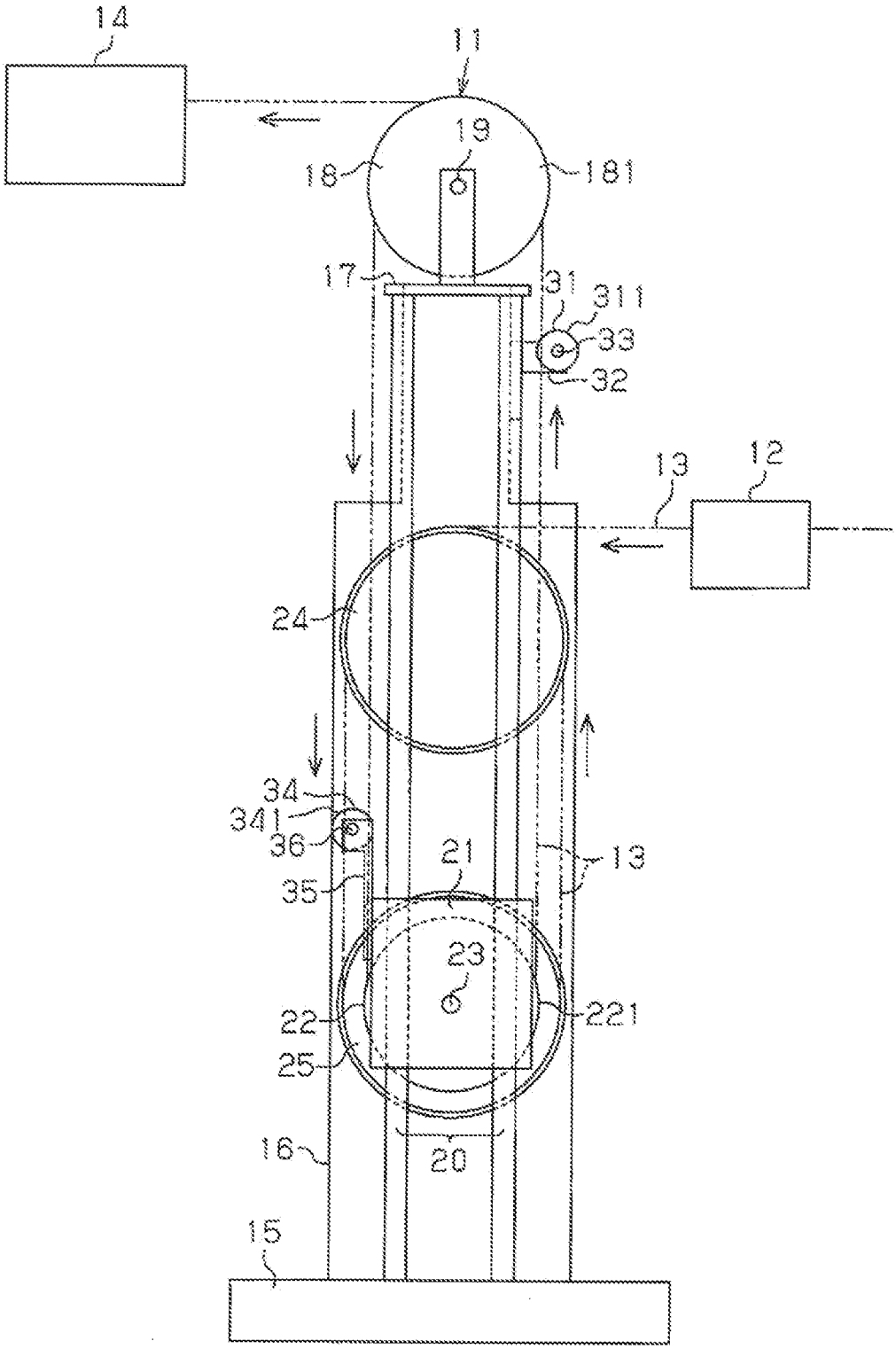
FIG. 1 is a front view of a festoon device according to one embodiment.

FIG. 1 shows a festoon device 11, which is installed between a die 12 and a bead core shaping device 14. In a process of manufacturing bead cores for tires, the die 12 carries out a preparation process of coating a wire with rubber, and the bead core shaping device 14 carries out a finishing process of forming a bead core by winding a coated wire 13. The festoon device 11 receives and stores the wire 13, which is coated with rubber by the die 12. The festoon device 11 then feeds the wire 13 to the bead core shaping device 14. The festoon device 11 has an adjustable storage capacity for the wire. This absorbs the difference between the moving amount of the wire 13 that is fed from the die 12 to the festoon device 11, and the moving amount of the wire 13 that is fed from the festoon device 11 to the bead core shaping device 14. Thus, the tension of the wire 13 is maintained at a constant level.

Figure 2:
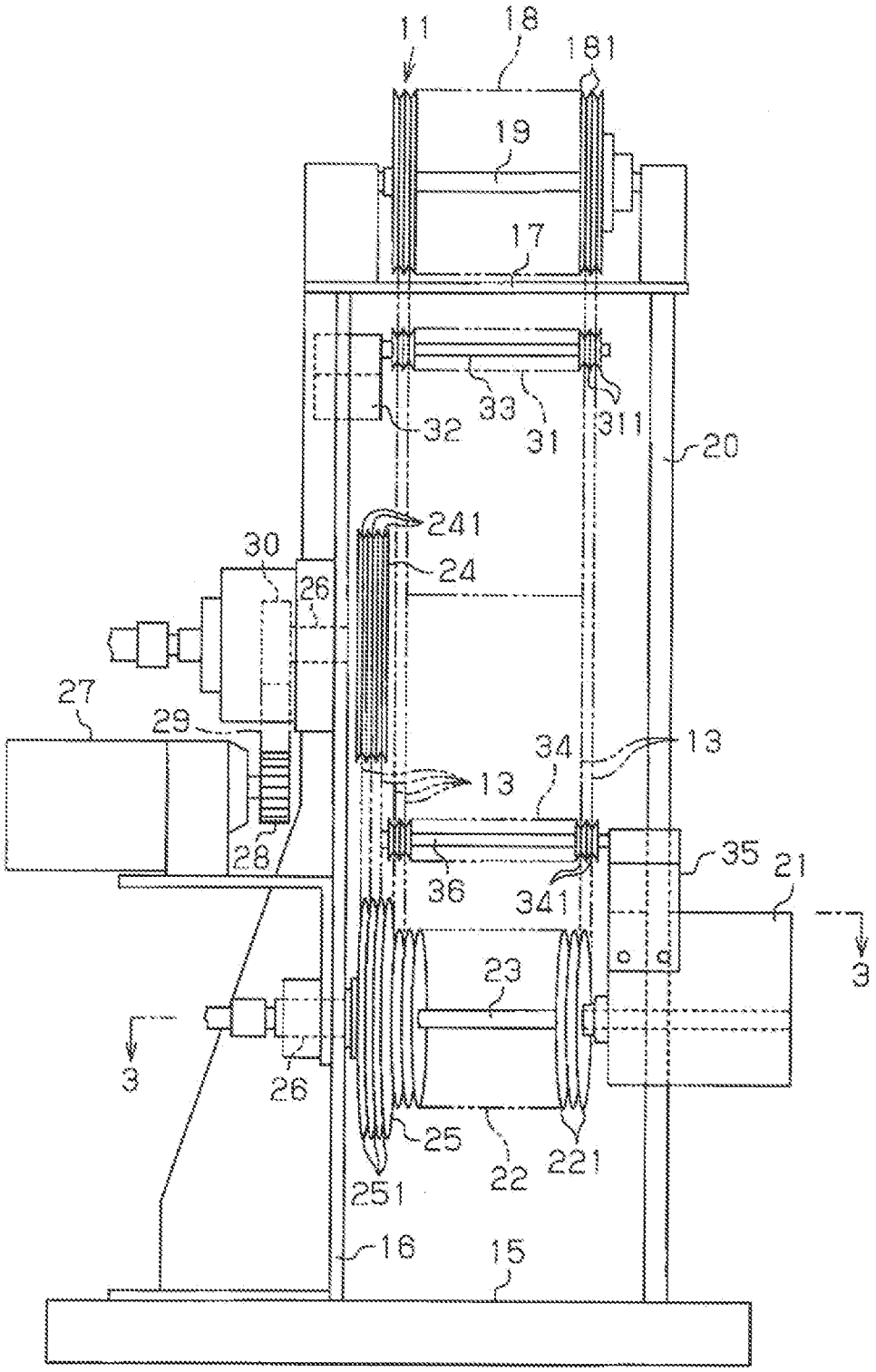
FIG. 2 is a side view of the festoon device of FIG. 1.
Figure 3:
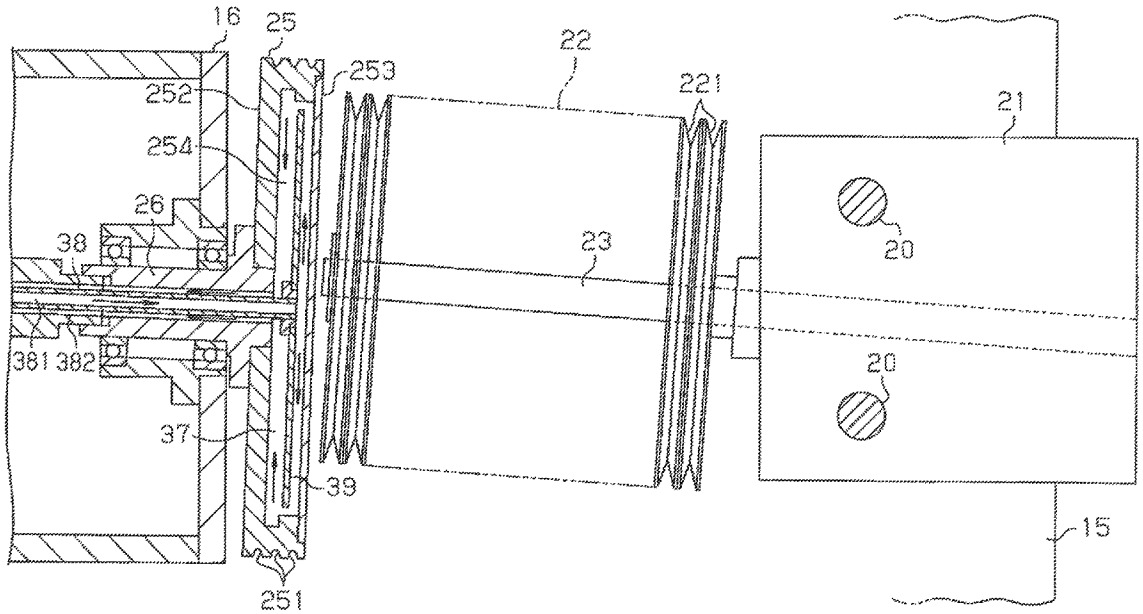
FIG. 3 is an enlarged cross-sectional view of a part of the festoon device taken along 3-3 of FIG. 2.

As shown in FIGS. 1 and 2, the festoon device 11 includes a frame 16 arranged to stand on a base 15. A support plate 17 is fixed to the top end of the frame 16 to extend toward the front (the right side of FIG. 2). The support plate 17 includes two projections that project upward from a front part and a rear part of the support plate 17. A spindle 19 extends in the front-back direction between the projections. The support plate 17 supports an upper pulley 18 via the spindle 19. The upper pulley 18 includes a plurality of pulley members 181 arranged side by side along the spindle 19. Each of the pulley members 181 is independently rotational about the spindle 19. Two guide rods 20 are arranged between the front ends of the base 15 and the support plate 17. The guide rods 20 are spaced from each other in the width direction of the frame 16 (the right-left direction of FIG. 1). The guide rods 20 support a weight 21, which is shaped like a cubic block, to be selectively moved up and down. The weight 21 rotationally supports a lower pulley 22 below the upper pulley 18. The lower pulley 22 includes a plurality of pulley members 221 arranged side by side along the spindle 23, which extends in the front-back direction. Each of the pulley members 221 is independently rotational about the spindle 23. The pulley members 181 of the upper pulley 18 and the pulley members 221 of the lower pulley 22 each have annular grooves formed on the respective outer circumferential surfaces to guide the wire 13. The wire 13 is looped multiple times around the upper pulley 18 and the lower pulley 22. At this time, the weights of the weight 21 and the lower pulley 22 exert a tension on the wire 13. As shown in FIG. 3, the spindle 23 in the lower pulley 22 extends at a predetermined angle relative to the extending direction of the spindle 19 in the upper pulley 18 on a horizontal plane. When looped around the lower pulley 22, the wire 13 is moved in a longitudinal direction of the spindle 19 in the upper pulley 18. The inclined angle of the spindle 23 in the lower pulley 22 is determined such that the moving amount at the moment corresponds to an array pitch between the annular grooves of the pulley members 181 in the upper pulley 18. Thus, the wire 13 between the upper pulley 18 and the lower pulley 22 travels to extend in a vertical direction, not in an inclined direction.

As shown in FIGS. 1 to 3, the front face of the frame 16 rotationally supports two auxiliary pulleys 24 and 25 via two respective spindles 26 at upper and lower parts of the front face, respectively. The upper and lower auxiliary pulleys 24 and 25 are located at respective positions in a space between the frame 16 and the upper and lower pulleys 18 and 22, i.e., at respective positions closer to the frame 16 than the upper pulley 18 and the lower pulley 22. The outer circumferential surfaces of the auxiliary pulleys 24 and 25 include a plurality of annular grooves 241 and 251 for guiding the wire 13, respectively. The wire 13, which is fed from the die 12, is looped around the auxiliary pulleys 24 and 25 and then looped around the upper pulley 18 and the lower pulley 22. As shown in FIG. 3, the lower auxiliary pulley 25 has a rotation axis that is inclined at a predetermined angle relative to the rotation axis of the upper auxiliary pulley 24 on a horizontal plane. Thus, the wire 13 between the auxiliary pulleys 24 and 25 does not extend at an angle but travels while extending vertically. The rear face of the frame 16 supports a motor 27 at a position corresponding to the upper auxiliary pulley 24. The rotation of the motor 27 rotates the upper auxiliary pulley 24 via a driving pulley 28, a belt 29, and a driven pulley 30.

As shown in FIGS. 1 and 2, in the festoon device 11, the wire 13 coated with rubber by the die 12 is looped multiple times around the auxiliary pulleys 24 and 25. After that, the wire 13 is looped multiple times around the upper pulley 18 and the lower pulley 22. The looped wire 13 is stored and then fed to the bead core shaping device 14. When the wire 13 is fed from the festoon device 11 to the bead core shaping device 14, the change in the moving amount of the wire 13 per unit time varies the tension of the wire 13. The lower pulley 22 is selectively moved up or down to balance the tension of the wire 13 with the weight of the lower pulley 22 and the weight 21. The up and down movement of the lower pulley 22 absorbs the difference between the moving amount of the wire 13 that is fed from the die 12 to the festoon device 11 and the moving amount of the wire 13 that is fed from the festoon device 11 to the bead core shaping device 14. As a result, the tension of the wire 13 is maintained at a constant level. In general, the wire 13 fed from the die 12 continuously moves with substantially an even moving amount. However, the wire 13 intermittently moves to shape a bead core in the bead core shaping device 14 since winding the wire in an annular shape on a forming member (not shown) and stopping the winding are alternately repeated. Thus, the up and down movement of the lower pulley 22 absorbs the difference between the moving amounts caused by the continuous movement and the intermittent movement.

As shown in FIGS. 1 and 2, the front face of the frame 16 supports an upper holding roller 31 via a bracket 32. The upper holding roller 31 is located adjacent to a lower part of the upper pulley 18 on one side in the width direction of the frame 16 (on a right side of FIG. 1 in the present embodiment). The upper holding roller 31 includes a plurality of roller members 311 arranged side by side along a spindle 33, which extends in a front-back direction. The roller members 311 are rotationally supported by the spindle 33. Each roller member 311 has an annular groove for guiding the wire 13 formed on the outer circumferential surface. The wire 13 traveling from the lower pulley 22 to the upper pulley 18 has a plurality of travelling sections. The roller members 311 of the upper holding roller 31 hold the respective travelling sections close to a lower part of the upper pulley 18 and inward from the outside in the width direction of the frame 16. This prevents the travelling sections of the wire 13 from vibrating so that the wire 13 is properly looped over the respective pulley members 181 of the upper pulley 18.

As shown in FIGS. 1 and 2, the rear face of the weight 21 supports the lower holding roller 34 via a bracket 35. The lower holding roller 34 is located at a position close to an upper part of the lower pulley 22. The lower holding roller 34 is located on the other side in the width direction of the frame 16, i.e. on the opposite side to the upper holding roller 31 in the width direction of the frame 16 (the left side of FIG. 1 in the present embodiment). The lower holding roller 34 includes a plurality of roller members 341 arranged side by side along a spindle 36, which extends in the front-back direction. The roller members 341 are rotationally supported by the spindle 36.

The outer circumferential surface of each roller member 341 includes an annular groove formed for guiding the wire 13. The wire 13 traveling from the upper pulley 18 to the lower pulley 22 has a plurality of travelling sections. The roller members 341 of the lower holding roller 34 hold the respective travelling sections inward from the outside in the width direction of the frame 16 close to the upper part of the lower pulley 22. This prevents the travelling sections of the wire 13 from vibrating, and the wire 13 is properly looped over the respective pulley members 221 of the lower pulley 22.

FIG. 3 shows a primary part of the inner structure in the lower auxiliary pulley 25. Each of the auxiliary pulleys 24 and 25 has a cooling medium passage 37, through which cooling medium such as water flows. The cooling medium passages 37, which are provided for the auxiliary pulleys 24 and 25, have the same structure. Thus, the structure of the lower auxiliary pulley 25, which is shown FIG. 3, will be described in detail. The auxiliary pulley 25 includes a hollow pulley body 252, which has an opening on the front face, and a cover 253, which is attached to the opening of the pulley body 252. The pulley body 252 and the cover 253 define a hollow chamber 254 inside the auxiliary pulley 25. The auxiliary pulley 25 is provided with a spindle 26, which is formed in a tubular shape to have a hollow that communicates with the hollow chamber 254. The feed pipe 38 is arranged in the hollow of the spindle 26 in the auxiliary pulley 25 to project into the hollow chamber 254. The feed pipe 38 has an outer diameter smaller than the inner diameter of the spindle 26. Accordingly, a feed passage 381 is formed inside the feed pipe 38 and is used for feeding the cooling medium to the hollow chamber 254. A drain passage 382 is formed outside the feed pipe 38 in the hollow of the spindle 26 and is used for draining the cooling medium out of the hollow chamber 254.

As shown in FIG. 3, a disk-like separator 39, which extends radially outward, is attached to an end of the feed pipe 38 in the hollow chamber 254 of the auxiliary pulley 25. The separator 39 partitions the hollow chamber 254 of the auxiliary pulley 25 into a front side area and a rear side area. The separator 39 has an outer diameter smaller than the inner diameter of the hollow chamber 254. The front side area communicates with the rear side area between the outer circumferential surface of the separator 39 and the inner circumference surface of the hollow chamber 254. The separator 39 defines the cooling medium passage 37 inside the hollow chamber 254 of the auxiliary pulley 25 to extend from the front side position to the rear side position via positions close to the outer circumference of the auxiliary pulley 25. The cooling medium is fed from the feed passage 381 inside the feed pipe 38 into the hollow chamber 254 of the auxiliary pulley 25 and flows through the cooling medium passage 37. The cooling medium is drained through the drain passage 382 outside the feed pipe 38. This cools the outer circumferential surface of the auxiliary pulley 25 to cool the rubber coating of the wire 13, which is processed by the die 12 in the preparation process. While the wire 13 is looped around the auxiliary pulley 25, the rubber coating of the wire 13 is hardened to a predetermined hardness.

Operation of the festoon device configured as above will now be described.

When the festoon device 11 is activated, the motor 27 rotates the upper auxiliary pulley 24. This causes the wire 13, which is coated with rubber by the die 12 in the preparation process, to be looped multiple times around the auxiliary pulleys 24 and 25. After that, the wire 13 is looped multiple times around the upper pulley 18 and the lower pulley 22 and is stored. The wire 13 is fed to the bead core shaping device 14, which carries out the finishing process. At this time, the cooling medium such as water is fed to the cooling medium passages 37, which are formed in the respective auxiliary pulleys 24 and 25 and cools the outer circumferential surfaces of the auxiliary pulleys 24 and 25. This cools the rubber coating of the wire 13, which is processed by the die 12 in the preparation process. While the wire 13 is looped around the auxiliary pulleys 24 and 25, the rubber coating of the wire 13 is hardened.

When the festoon device 11 is activated, the lower pulley 22 is selectively moved up or down according to the moving amount of the wire 13 fed from the festoon device 11 to the bead core shaping device 14. In particular, the lower pulley 22 is moved up when the moving amount of the wire 13 fed from the festoon device 11 to the bead core shaping device 14 becomes greater than the moving amount of the wire 13 fed from the die 12 to the festoon device 11. In contrast, the lower pulley 22 is moved down when the moving amount of the wire 13 fed from the festoon device 11 to the bead core shaping device 14 becomes less than the moving amount of the wire 13 fed from the die 12 to the festoon device 11. This absorbs the difference between the moving amount of the wire 13 fed from the die 12, which carries out the preparation process, and the moving amount of the wire 13 fed to the bead core shaping device 14, which carries out the finishing process. As a result, the tension of the wire 13 is maintained at a constant level.

Accordingly, the present embodiment achieves the following advantages.

(1) In the festoon device, the upper part of the frame 16 rotationally supports the upper pulley 18. The frame 16 rotationally supports the lower pulley 22 at a position below the upper pulley 18 to be selectively moved up and down. The frame 16 supports the auxiliary pulleys 24 and 25, which are arranged at the upper and lower positions, respectively, in front of the frame 16 and behind the upper pulley 18 and the lower pulley 22. The rubber-coated wire 13 is looped around the auxiliary pulleys 24 and 25, and then is looped multiple times around the upper pulley 18 and the lower pulley 22 to be stored. The wire 13 is fed to the bead core shaping device 14.

Thus, the above-illustrated festoon device 11 does not need to increase the widthwise size of the frame 16, while the frame 16 supports the auxiliary pulleys 24 and 25, of which rotation axes extend along the rotation axes of the upper pulley 18 and the lower pulley 22, respectively. Therefore, the festoon device 11 is configured to decrease the overall size.

(2) The festoon device includes the cooling medium passages 37 inside the auxiliary pulleys 24 and 25. Thus, the cooling medium cools the outer circumferential surfaces of the auxiliary pulleys 24 and 25. This allows the rubber coating, which is applied to the wire 13 in the preparation process, to harden while the wire 13 is looped around the auxiliary pulleys 24 and 25.

(3) In this festoon device, the cooling medium passage 37, which is included in each of the auxiliary pulleys 24 and 25, is formed to be routed from the front side position to the rear side position via positions close to the outer circumference of the auxiliary pulley 24(25). Thus, the cooling medium flows from the front side position to the rear side position through the cooling medium passage 37 in the auxiliary pulley 24(25) while passing via the positions close to the outer circumference of the auxiliary pulley 24(25). This allows the cooling medium to effectively cool the outer circumferential surface of the auxiliary pulley 24(25).

(4) In the festoon device, each of the auxiliary pulleys 24 and 25 includes the corresponding hollow chamber 254, in which the corresponding disk-shaped separator 39 is provided to define the corresponding cooling medium passage 37. Thus, the simple structure of providing the separator 39 in the hollow chamber 254 of the auxiliary pulley 24(25) allows the cooling medium passage 37 to be formed inside without increasing the thickness of the auxiliary pulley 24(25). This contributes to reduce the overall size of the festoon device 11.

(5) In the festoon device, the wire 13 that travels to be looped around the upper pulley 18 and the lower pulley 22 includes a plurality of travelling sections. The holding rollers 31 and 34 are provided to hold the travelling sections inward from the outside. This prevents the travelling sections of the wire 13 from vibrating between the upper pulley 18 and the lower pulley 22 so that the wire 13 is properly placed at a predetermined position on the upper pulley 18 and the lower pulley 22.

Modifications

The above-illustrated embodiment may be modified in the following forms.

In the above-illustrated embodiment, the cooling medium passages 37 may be formed inside the auxiliary pulleys 24 and 25.

In the above-illustrated embodiment, the cooling medium may be coolant or air instead of water.

DESCRIPTION OF THE REFERENCE NUMERALS

11 . . . festoon device, 12 . . . die, 13 . . . wire, 14 . . . bead core shaping device, 16 . . . frame, 18 . . . upper pulley,

20 . . . guide rod, 21 . . . weight, 22 . . . lower pulley, 24 . . . upper auxiliary pulley, 25 . . . lower auxiliary pulley, 254 . . . hollow chamber, 37 . . . cooling medium passage, 39 . . . separator.

The invention claimed is:

1. A festoon device comprising:

a frame, which extends vertically and includes a guide rod extending vertically;

an upper pulley, which is rotationally supported by an upper part of the frame;

a weight, which is located below the upper pulley and supported by the guide rod to be moved up and down along the guide rod, a lower pulley, which is located below the upper pulley and rotationally supported by the weight, a wire, which is looped about the upper pulley and the lower pulley; and two auxiliary pulleys, which are arranged closer to the frame than the upper pulley and the lower pulley and are rotationally supported by the frame, wherein the festoon device is configured such that the wire is looped about the upper pulley and the lower pulley after being looped about the auxiliary pulleys and that the lower pulley is selectively moved up and down via the weight to balance a tension of the wire with a total weight of the lower pulley and the weight, a cooling medium passage is formed in each of the auxiliary pulleys, and in each of the auxiliary pulleys, the cooling medium passage includes a first section, which extends outward in a radial direction of the auxiliary pulley from a center of the auxiliary pulley in the radial direction, a second section, which extends in a thicknesswise direction of the auxiliary pulley from a terminal end of the first section, and a third section, which extends inward in the radial direction from a terminal end of the second section and is located at a rear side of the first section.

2. The festoon device according to claim 1, wherein the two auxiliary pulleys are vertically spaced from each other.

3. The festoon device according to claim 1, wherein each of the auxiliary pulleys includes a hollow chamber, and a disk-shaped separator is provided to partition an interior of the hollow chamber to form the cooling medium passage.

4. The festoon device according to claim 1, wherein, in each of the auxiliary pulleys, the first section of the cooling medium passage is connected to a feed passage for feeding a cooling medium to the cooling medium passage, and the third section of the cooling medium passage is connected to a drain passage for draining the cooling medium out of the cooling medium passage.

* * * * *